US005419297A

United States Patent [19]

Peterson, Jr. et al.

[11] Patent Number: 5,419,297

[45] Date of Patent: May 30, 1995

[54] EXTENDED TIP GASOLINE PORT FUEL INJECTOR

[75] Inventors: William A. Peterson, Jr., Lake Orion, Mich.; John F. Nally, Jr., Williamsburg, Va.

[73] Assignee: Siemens Automotive L.P., Auburn Hills, Mich.

[21] Appl. No.: 268,004

[22] Filed: Jun. 28, 1994

[51] Int. Cl.[6] ..... F02M 37/04

[52] U.S. Cl. ..... 123/470; 123/472; 239/533.12

[58] Field of Search ..... 123/470, 471, 472, 184.21; 239/533.12

[56] References Cited

U.S. PATENT DOCUMENTS

| | | | |
|---|---|---|---|
| 4,013,229 | 3/1977 | Rohs | 239/533.14 |
| 4,018,387 | 4/1977 | Erb | 239/533.12 |
| 4,143,625 | 3/1979 | Kulke | 123/470 |
| 4,519,371 | 5/1985 | Nagase | 123/470 |
| 4,650,122 | 3/1987 | Kienzle | 239/533.12 |
| 4,922,876 | 5/1990 | Mizoguchi | 123/470 |
| 4,979,479 | 12/1990 | Furukawa | 123/472 |
| 5,156,124 | 10/1992 | Sugimoto | 123/470 |
| 5,201,806 | 4/1993 | Wood | 239/533.12 |

FOREIGN PATENT DOCUMENTS

| | | | |
|---|---|---|---|
| 2242824 | 3/1974 | Germany | 123/470 |
| 2439593 | 2/1976 | Germany | 123/470 |
| 0249665 | 12/1985 | Japan | 123/470 |
| 0193077 | 8/1989 | Japan | 123/470 |
| 4143456 | 5/1992 | Japan | 123/470 |

*Primary Examiner*—Carl S. Miller

*Attorney, Agent, or Firm*—George L. Boller; Russel C. Wells

[57] ABSTRACT

The fuel injector nozzle injects fuel into the runner in a direction that may be either parallel or non-parallel to the co-axis of the fuel injector and its mounting socket, and the nozzle orifice from which the fuel is injected is disposed beyond an antechamber of the mounting socket so as to lie within the runner, hence injecting the fuel from the orifice at a location that does not lie within the antechamber of the mounting socket.

5 Claims, 1 Drawing Sheet

EXTENDED TIP GASOLINE PORT FUEL INJECTOR

FIELD OF THE INVENTION

This invention relates to spark-ignition internal combustion engines that utilize a fuel, like gasoline, as distinguished from other forms of internal combustion engines, like diesel engines. More specifically, the invention relates to the mounting of a fuel injector in association with a runner to an engine cylinder for the purpose of minimizing, and possibly even eliminating, wetting of wall surfaces where the runner approaches the intake of the cylinder.

BACKGROUND AND SUMMARY OF THE INVENTION

Research has discovered that port-injected fuel that wets wall surfaces leading to a cylinder intake can make a detrimental contribution to undesired tailpipe emissions. Because of increasingly strict regulation of tail pipe emissions, it has become increasingly important that such wall wetting be minimized to the greatest degree possible, and ideally eliminated entirely. A common construction of a mounting socket for an electrically operated gasoline fuel injector that injects fuel into a runner leading to a cylinder's intake comprises an antechamber immediately adjoining the socket's intersection with the runner. In a typical fuel injector, an O-ring seal is present near the injector tip. Certain constraints or considerations, such as for example, 1) the need for sufficiently strong wall structure at the location where the injector mounting socket intersects the runner, 2) packaging constraints that are imposed on the underhood mounting of the engine in an automotive vehicle, 3) the size and shape of a runner, and/or 4) the particular fuel injector to be used, will typically dictate the disposition of a fuel injector mounting socket in relation to its associated runner. The resulting designs have heretofore disposed the tip, or nozzle, of the fuel injector in the antechamber and the injector is constructed to deliver the injected fuel toward a target zone, typically a cylinder intake valve. Such delivery may take different forms such as a bent stream, i.e. a stream that is non-parallel to the axis of the injector, or a straight stream, i.e. one that is co-axial with the co-axis of the fuel injector and its mounting socket. Several examples of port-injection are shown in U.S. Pat. Nos. 5,085,369; 5,156,130; and 5,201,806.

It has now been discovered that the presence of the injection point within the antechamber can give rise to some small, but nonetheless significant insofar as tail pipe emissions are concerned, amount of recirculation of injected fuel that tends to promote wall wetting to the detriment of tail pipe emissions. It may be generally said that the present invention relates to a new and unique organization and arrangement for a gasoline port fuel injector that can accommodate constraints and considerations such as those mentioned above, yet also reduces or eliminates the aforementioned recirculation problem.

Briefly the invention comprises: an internal combustion, spark-ignition engine comprising an intake runner through which air is inducted into an engine cylinder and an electrically operated fuel injector disposed coaxially within a fuel injector mounting socket that intersects the runner, said mounting socket comprising an antechamber immediately adjoining the socket's intersection with the runner, an O-ring seal disposed to seal a circumference of said fuel injector to said socket at a location that leaves at least some of said antechamber unsealed from said runner, said fuel injector comprising a nozzle from which fuel is injected into said runner for entrainment with air passing through said runner in a direction toward an intake of said engine cylinder, said fuel injector nozzle comprises orifice means at which the injected fuel exits the fuel injector, characterized in that said orifice means is disposed beyond said antechamber so as to lie within said runner and inject the fuel from a location that does not lie within said antechamber.

The invention is disclosed in an embodiment further characterized in that said fuel injector's orifice means are in a disk that is disposed transversely within a body portion of said nozzle leaving said body portion with a rim disposed just beyond said disk, and the entirety of said rim is disposed beyond said antechamber so as to lie within said runner.

The disclosed embodiment of the invention is still further characterized in that said orifice means is disposed substantially on the axis of the fuel injector, and the fuel is injected in a direction that is non-parallel to the co-axis of the fuel injector and its mounting socket.

Principles of the invention may be incorporated into embodiments other than the one specifically illustrated in the accompanying drawing, such as one in which the injector stream or spray is parallel with the co-axis of the injector and its mounting socket.

Features, advantages, and benefits of the invention will be seen in that drawing as well as in accompanying description and claims disclosing a presently preferred embodiment according to the best mode contemplated at this time for carrying out the invention.

DESCRIPTION OF THE PREFERRED EMBODIMENT

Figure 1:
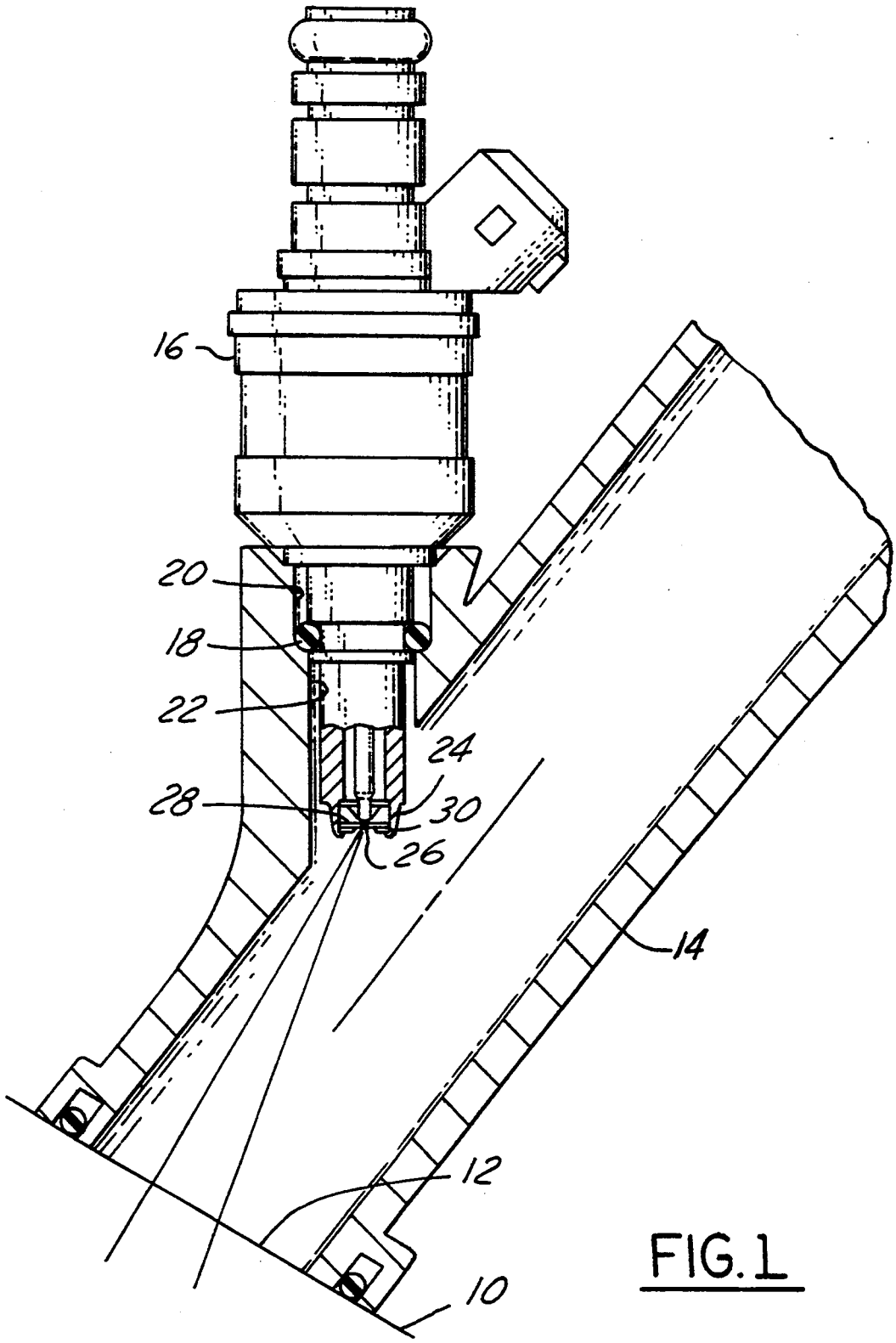
FIG. 1 is a partial longitudinal cross sectional view in accordance with principles of the invention of an example of an engine runner including a fuel injector mounting socket containing a fuel injector.

A spark-ignition internal combustion engine 10 comprises a valve-controlled intake 12 to which the downstream end of an intake runner 14 is communicated in a sealed manner. Runner 14 conveys induction air to an engine cylinder when intake 12 is open. Engine 10 includes an electrically operated gasoline fuel injector 16 that injects fuel into runner 14 for entrainment with intake air to create a combustible charge for the engine cylinder. This is an example of port injection. After a charge has been inducted into the cylinder and intake 12 has been closed, the charge is ignited by a spark plug (not shown) to release energy for operating the engine in the usual manner.

Fuel injector 16 is similar to that disclosed in a number of commonly assigned patents such as U.S. Pat. No. 5,201,806 except that the length of the valve body is extended axially beyond the location of an O-ring seal 18 that is disposed circumferentially around the valve body so that the injection point is disposed within runner 14.

Fuel injector 16 is disposed coaxially in a mounting socket 20 that transversely intersects runner 14 at an acute angle to a section of the length of the runner where the socket intersects the runner. Mounting socket 20 comprises an antechamber 22 immediately adjoining the socket's intersection with runner 14. O-ring seal 18 is disposed to seal a circumference of the fuel injector's valve body to socket 20 at a location that leaves at least some of antechamber 22 unsealed from runner 14.

Fuel injector 16 comprises as a part of its valve body, a tip, or nozzle, 24 from which fuel is injected into runner 14 for entrainment with the air passing through the runner in a direction that is toward intake 12 and that in this example of the invention is non-parallel to the longitudinal co-axis of socket 20 and fuel injector 16. The fuel injector nozzle comprises orifice means 26 at which the injected fuel exits the fuel injector, and orifice means 26 is disposed beyond antechamber 22 so as to lie within runner 14. Hence, the fuel is injected from a location that does not lie within antechamber 22.

Orifice means 26 may comprise one or more orifices in a disk 28 that is disposed transversely within the valve body leaving the body with a rim 30 disposed just beyond disk 28 so that the entirety of the rim is disposed beyond antechamber 22 so as to lie within runner 14. In the illustrated embodiment, the orifice means is disposed substantially on the axis of fuel injector 16.

By disposing the orifice means in the manner disclosed herein, improvement can be achieved in both a moving and a non-moving airstream. When air is being inducted, the tip will aid in shearing the liquid particles off the tip. Additionally, the adverse effect of a recirculation zone that has been often found to be present in the antechamber when the tip is in the antechamber and that contributes to wall wetting, is alleviated by extending the tip in the manner of the invention.

While the disclosed embodiment shows the tip extended in length and the O-ring in the same relative position in the injector mounting socket, the injection point may be placed within the runner in other ways, such as by leaving the tip-to-O-ring distance the same as in a non-extended tip, and then designing the mounting socket so that the fuel injector is disposed more interiorly therein.

It should be appreciated that the drawing is specific only regarding details of the invention, and it is to be understood that a fuel rail would be fitted to the fuel injector's top-feed inlet and an electrical connector to its electrical plug. Also while a presently preferred embodiment of the invention has been illustrated and described, it should be appreciated that principles may be incorporated into embodiments other than the one specifically illustrated herein, and that are equivalent to the following claims. The need for other embodiments may arise because of different intake runner geometries. For example, the injector stream or spray could be co-axial with the co-axis of the fuel injector and its mounting socket.

What is claimed is:

1. An extended tip electromagnetic fuel injector adapted to be mounted in a socket in a tubular intake runner upstream of an intake valve of an internal combustion engine for use in a port fuel injection system having a housing, a solenoid within the housing, an armature operatively connected to the solenoid and operable to move along the axis of the fuel injector, inlet means for receiving fuel into the fuel injector, a nozzle means having a valve body means positioned at the outlet of the fuel injector, the valve body means located at the tip of the injector including a needle connected to the armature for opening and closing the outlet, and an orifice means positioned between the tip and downstream from the valve means for metering the amount of fuel ejected from the fuel injector when the outlet is opened, characterized in that the orifice means and the valve means are positioned adjacent the tip;

an O-ring seal mounted around the housing for sealing the fuel injector into the runner, said seal being axially displaced from the tip of the injector toward the opposite end of the injector so as to extend the tip and position the orifice means of the injector into the tubular runner to meter fuel from the injector; and the orifice means positioned to direct the ejected fuel from the injector and directly on the intake valve not on the walls of the runner.

2. An extended tip electromagnetic fuel injector as set forth in claim 1 which the orifice means is in a disk that is disposed transversely within the nozzle and said body having a rim disposed just beyond said disk, and the entirety of said rim lies within the runner.

3. An extended tip electromagnetic fuel injector as set forth in claim 1 in which said orifice means is disposed substantially on the axis of the fuel injector and directed to the intake of the engine cylinder and not on the wall surface of the intake runner.

4. An extended tip electromagnetic fuel injector as set forth in claim 1 in which the nozzle ejects fuel from the orifice means in a direction that is non-parallel to the axis of the socket and the fuel injector.

5. An extended tip fuel electromagnetic injector as set forth in claim 2 wherein the injector is coaxially aligned with the socket and the orifice means is aligned to eject fuel from the nozzle in a direction that is non-parallel to the axis of the fuel injector and not colliding with the wall of the runner.

* * * * *